US007520843B1

(12) United States Patent
Goddard

(10) Patent No.: US 7,520,843 B1
(45) Date of Patent: Apr. 21, 2009

(54) DUAL LIFT APPARATUS

(76) Inventor: Dan Goddard, 5025 N. Central Ave., #243, Phoenix, AZ (US) 85012

( * ) Notice: Subject to any disclaimer, the term of this patent is extended or adjusted under 35 U.S.C. 154(b) by 0 days.

(21) Appl. No.: 11/776,515

(22) Filed: Jul. 11, 2007

Related U.S. Application Data

(63) Continuation-in-part of application No. 11/349,514, filed on Feb. 6, 2006.

(51) Int. Cl.
*A63B 21/06* (2006.01)
*A63B 21/072* (2006.01)
*A63B 21/078* (2006.01)

(52) U.S. Cl. ..... 482/104; 482/98; 482/106; 482/135

(58) Field of Classification Search ..... 482/17, 482/38, 92–98, 100–104, 106, 135, 138, 482/99, 107, 108
See application file for complete search history.

(56) References Cited

U.S. PATENT DOCUMENTS 3,524,644 A * 8/1970 Kane ..... 482/129
3,640,552 A 2/1972 Proctor
3,866,914 A * 2/1975 Jackson ..... 473/438
3,912,263 A * 10/1975 Yatso ..... 482/98
4,354,676 A * 10/1982 Ariel ..... 482/5
4,369,966 A 1/1983 Silberman et al.
D284,780 S 7/1986 Brentham
4,627,615 A * 12/1986 Nurkowski ..... 482/98
4,729,561 A 3/1988 Desjardins
4,730,828 A * 3/1988 Lane ..... 482/94
4,907,798 A * 3/1990 Burchatz ..... 482/99
4,955,604 A 9/1990 Pogue
4,971,305 A * 11/1990 Rennex ..... 482/93
4,973,050 A * 11/1990 Santoro et al. ..... 482/102
5,044,629 A * 9/1991 Ryan et al. ..... 482/101
5,082,260 A 1/1992 Dinelli
5,328,430 A * 7/1994 Vittone et al. ..... 482/102
5,348,523 A 9/1994 Blount
5,509,876 A 4/1996 Reyes
5,626,539 A 5/1997 Piaget et al.
5,989,164 A 11/1999 Kullman et al.
6,632,159 B1 * 10/2003 Slattery ..... 482/94
6,685,601 B1 2/2004 Knapp
7,374,516 B2 * 5/2008 Lundquist ..... 482/104
7,393,309 B2 * 7/2008 Webber ..... 482/104
2005/0070407 A1 * 3/2005 Alessandri et al. ..... 482/148
2005/0202941 A1 * 9/2005 Vaes ..... 482/94

FOREIGN PATENT DOCUMENTS

CA 1288790 C * 9/1991

* cited by examiner

*Primary Examiner*—Loan H Thanh
*Assistant Examiner*—Victor K Hwang
(74) *Attorney, Agent, or Firm*—Schmeiser, Olsen & Watts LLP

(57) ABSTRACT

A dual lift apparatus is provided for use by up to two people to perform the same lifts and exercises simultaneously. The apparatus includes a frame, guide rods, weight guides and a weight bar. In a particular embodiment, the apparatus includes three guide rods coupled vertically within the frame. The three guide rods include two side guide rods and a middle guide rod that is positioned at about the center point between the two side guide rods. The apparatus may include a weight holder positioned at about the center point of the weight bar so that the weight is more evenly distributed between the two lifters. In another embodiment, the apparatus includes an adapter for switching between a roller weight guide and a linear bearing weight guide.

19 Claims, 9 Drawing Sheets

DUAL LIFT APPARATUS

CROSS REFERENCE TO RELATED APPLICATION

This application is a Continuation-in-Part of U.S. patent application Ser. No. 11/349,514 to Danny Jay Goddard entitled "DUAL LIFT APARATUS," filed Feb. 6, 2006, the disclosure of which is hereby incorporated entirely herein by reference.

BACKGROUND OF THE INVENTION

1. Technical Field

This invention relates generally to weight lifting apparatuses and more particularly to a dual weight lifting apparatus for use by two people simultaneously.

2. State of the Art

There are various machines available for weight training. These machines often have a strict range of motion which the user has to follow in order to lift the weights. This is beneficial to a user of the machine by allowing the user to more easily isolate and target specific muscles and muscle groups. Free weights allow the user to better develop the muscle groups and are essential for advanced weight training. Particular machines provide a combination of a machine with free weights, allowing the user to adjust the weight and receive some benefits of free weights, while retaining the structure and form of the machines. An example of a conventional machine that accomplishes this is commonly referred to as a Smith Machine.

The conventional machines restrict the movement of the weights along a bar that is fixed vertically within a frame. The frame supports the weights and the mechanisms that allow movement of the weights. These conventional machines however have two particular limitations.

First, the machines are restricted to use by a single user at a time. This restriction to a single user provides limitations, particularly for a person who has suffered an injury, wherein muscles have been weakened by causes such as atrophy or have lost use of particular muscles such as pectoralis, deltoids and biceps, as well as for people who have particular physical disabilities, such as amputees and those with special needs. They are unable to perform weight lifting exercises alone and need the benefit of another person to assist them. Additionally, the ability for two people to use the same machine simultaneously provides comradery and motivation to extend greater effort for each person, regardless of whether either person has an injury, is disabled, or desires to perform two person lifts.

Second, the conventional machines' mechanisms for allowing movement are limited to linear bearings. These bearings have a limited life before repair or replacement is needed, they limit the smoothness of travel of the weights and movement mechanisms, and they are only useable on round guide rods that have hardness greater than the hardness of the bearings. Additionally, if the bearings wear unevenly, the machines often have a problem with one side of the bar traveling more smoothly than the other side, causing the bar to angle upon lifting it and not allowing the bar to turn, thereby restricting proper motion of the machine and compromising the intended exercise being performed.

Accordingly, there is a need in the field of weight lifting for an improved weight lifting apparatus.

DISCLOSURE OF THE INVENTION

The present invention relates to a dual lift apparatus that allows two people to perform the same exercises together and simultaneously. The apparatus is generally of a type that restricts the lifting motion to a path defined by the structure of the apparatus.

An aspect of the present invention includes a dual lift apparatus for use by two people for lifting weights simultaneously, the apparatus comprising a frame, at least two guide rods coupled substantially vertical within the frame, and at least two weight guides, each weight guide operatively coupled to at least one guide rod and configured to support a weight bar, wherein each of the at least two weight guides comprise at least two rollers, the rollers engaging the guide rods to provide movement of the weight guides and weight bar along the guide rods.

Another aspect of the present invention includes a dual lift apparatus for use by up to two people for lifting weights simultaneously, the apparatus comprising a frame, at least two guide rods coupled substantially vertical within the frame, and at least two weight guides, each weight guide operatively coupled to at least one guide rod and configured to support a weight bar, wherein the frame has a length defined by the distance between the at least two guide rods, the length being within a range of approximately 80 to 130 inches.

Yet another aspect of the present invention includes a dual lift apparatus for use by two people for lifting weights simultaneously, the apparatus comprising a frame, at least two guide rods coupled substantially vertically within the frame, and at least two weight guides, each weight guide operatively coupled to a single guide rod and configured to support a weight bar, wherein the weight bar has a length within a range of approximately 125 to 180 inches.

Still another aspect of the present invention includes a dual lift apparatus for use by two people for lifting weights simultaneously, the apparatus comprising a frame, three guide rods coupled substantially vertically within the frame and three weight guides, each weight guide operatively coupled to a single guide rod and configured to support a weight bar. The three guide rods include two side guide rods and a middle guide rod. The middle guide rod is positioned at about the center point between the two side guide rods.

In another aspect of the invention, independent or dual benches are used. Each bench is independently adjustable in the height to compensate for users having different arm lengths and/or chest thicknesses.

In yet another aspect of the invention, the weight guides include either rollers or linear bearings and the apparatus includes an adapter for switching between roller weight guides and linear bearing weight guides.

In still another aspect of the invention, the weight bar includes a weight holder positioned at about the center point of the weight bar for holding weights so that the weight may be more evenly distributed between the two lifters.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

As a preface to the detailed description, it should be noted that, as used in this specification and the appended claims, the singular forms "a," "an" and "the" include plural referents, unless the context clearly dictates otherwise. Further, as used herein, "simultaneous" means performance of the same lift, at the same time by at least two users of an apparatus according to embodiments of the present invention.

As discussed above, embodiments of the present invention relate to a dual lift apparatus that allows up to two people to perform the same exercises simultaneously, the apparatus restricting the lifting motion to a path defined by the structure of the apparatus. Generally, the apparatus comprises a frame, at least two guide rods, at least two weight guides and a weight bar.

Figure 1:
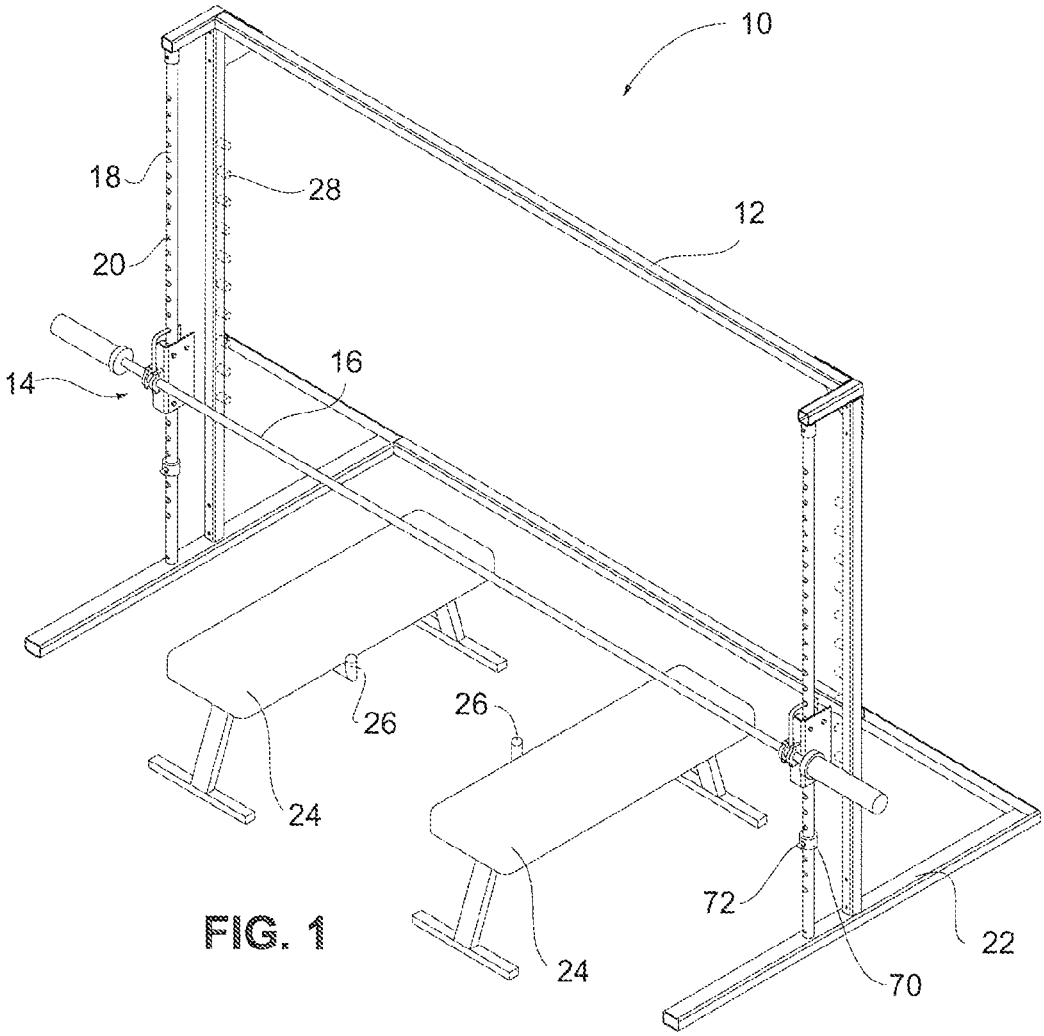
FIG. 1 is a perspective view of a dual lift apparatus, in accordance with embodiments of the present invention.
Figure 2:
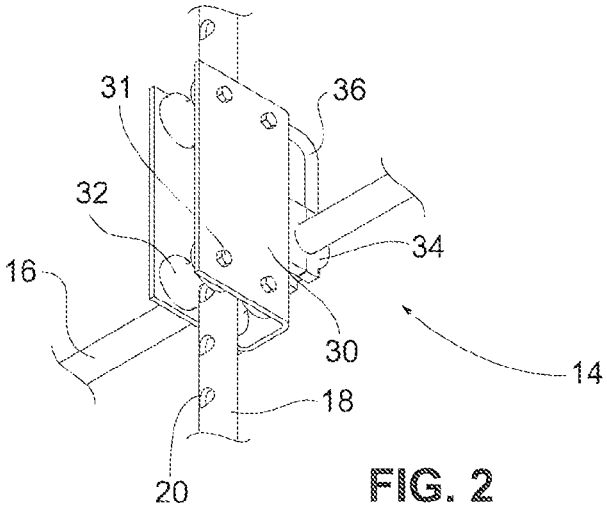
FIG. 2 is a perspective view of a weight guide of a dual lift apparatus, in accordance with embodiments of the present invention.

As shown in FIGS. 1 and 2, particular embodiments of the present invention comprise a dual lift apparatus 10. The apparatus 10 comprises a frame 12, the frame having a base 22 to support the frame 12, at least two guide rods 18, at least two weight guides 14 and a weight bar 16. The guide rods 18 are coupled substantially vertical within the frame 12. The weight guides 14 are each operatively coupled to at least one guide rod 18 and configured to support the weight bar 16. Each of the weight guides 14 comprise at least two rollers 32, the rollers 32 engaging the guide rods 18 to provide movement of the weight guides 14 and weight bar 16 along the guide rods 18. The weight guides 14 may further comprise a case 30, a weight bar receiver 34 and a lock device 36. The rollers 32 may be coupled within the case 30 by use of fasteners 31. The weight bar receiver 34 is coupled to the case 30 and is configured to couple to the weight bar 16, while allowing the weight bar 16 to rotate about its axis. The lock device 36 may be configured to engage apertures 20 of the guide rod 18 to lock the weight guide 14 in place. The lock device 36 may further be configured to lock onto lock bars 28 of the frame 12.

It will be understood that the shape of the guide rods 18 may be various shapes in cross section, such as, but not limited to, circular, rectangular and square. The shape of the guide rods 18 further determines the shape of the rollers 32, wherein the rollers 32 are cylindrical with the axis of the cylinder being the axis of rotation and are adapted to properly correspond to the shape of the guide rod 18. For example, and not as a limitation, for circular guide rods 18, the roller 32 may have an outer surface with a substantially equal radius of curvature to correspond to the radius of the cross section circle of the guide rod 18 to provide proper contact between the rollers 32 and the guide rods 18. For additional example and not as a limitation, for square guide rods 18, the rollers 32 may have a substantially linear outer surface wherein the roller corresponds to a side of the square-shaped guide rod 18. Additionally, while particular embodiments of the present invention use at least two rollers 32, other embodiments may use different amounts of rollers 32, such as, but not limited to three rollers and four rollers. It is also contemplated that while particular embodiments of the present invention have weight guides 14 with rollers 32, other embodiments may have weight guides 14 that do not use rollers 32 for movement.

The frame 12 may be of a size and shape to allow two users to use the apparatus 10 simultaneously. In particular embodiments of the present invention, the frame 12 may have a length defined by the distance between each guide rod 18, the length being within a range of approximately 80 to 130 inches. The length of the weight bar 16 may be within a range of approximately 125 to 180 inches. In other embodiments of the invention, the weight bar 16 may have a length range of approximately 135 to 150 inches. Further still, in other embodiments of the invention, the frame may have a length of approximately 93 inches.

The apparatus 10 may further comprise at least two benches 24. The benches 24 enable up to two users to perform certain types of lifts that require a bench for proper positioning and exercising of the muscles. The benches 24 may further comprise at least one moveable securable handle 26, wherein the handle 26 provides support for a user who is lifting with one hand. The handle 26 may be gripped with one hand of the user while the other hand is gripping the weight bar 16. As the user lifts the weight with one hand and arm, the handle 26 may be used for balancing on the bench and supporting the user as he or she lifts. This is particularly beneficial for two users who are each lifting the bar 16 simultaneously with one hand. They may each support themselves and provide proper lifting of the weight bar 16. It will be understood by those of ordinary skill in the art that the handle 16 may be located on either side of the bench 24 or on both sides of the bench 24.

The weight bar 16 may be configured to receive and retain standard free weight plates. It will be understood that various types of plates may be used, such as, but not limited to, Olympic weight plates or other weight plates, wherein the hole for receiving the bar is of any size and the bar 16 may be adapted for use with any size weight plate. Also, the weight bar 16 may be of any shape cross section, such as, a circle, oval, square, pentagon, hexagon, octagon or any other rectilinear shape, so long as the weight bar functions in accordance with the present invention. Further, the weight bar 16 may be of a size and shape to extend across the entire frame 12 and may be formed of a material of sufficient strength so as to maintain its shape with large amounts of weights coupled on each end of the weight bar 16. In particular embodiments of the present invention, the apparatus 10 may use stacked weights that are lifted in place of the free weight plates. These particular embodiments would allow a user to lock a particular amount of weight using a pin coupled to a bar retaining the weights, wherein the pin allows only the selected amount of weight to be lifted. These particular embodiments may further include a pulley system with cables to couple the weight bar 16 to the weight stacks.

Figure 3:
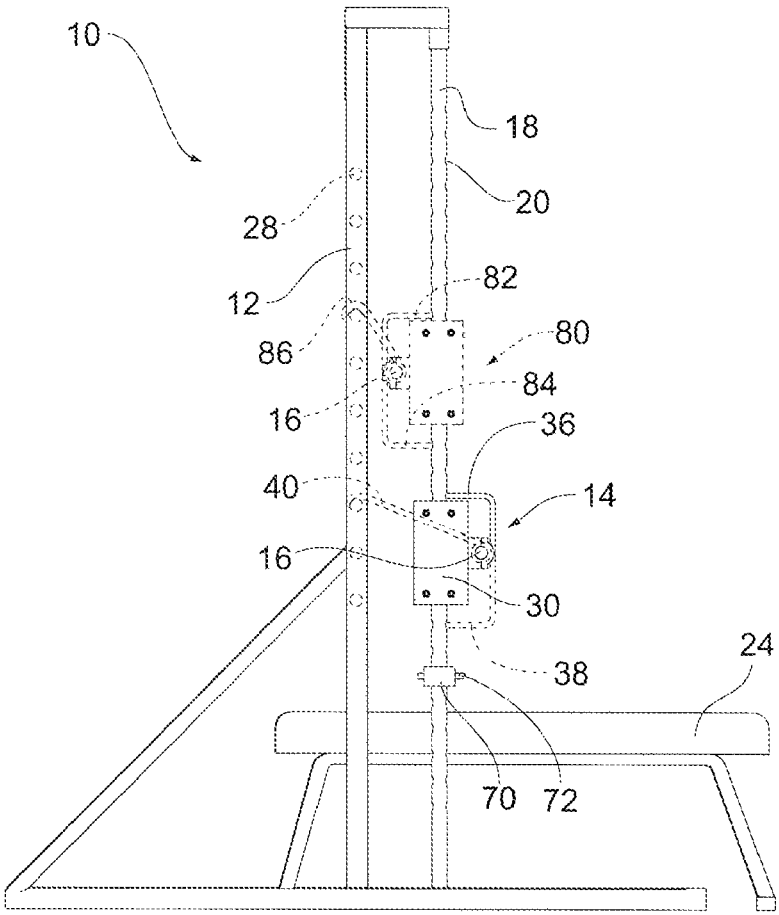
FIG. 3 is a side view of a dual lift apparatus, in accordance with embodiments of the present invention.

Referring further to the drawings, FIG. 3 depicts a side view of a dual lift apparatus 10 according to embodiments of the present invention. The apparatus 10 comprises a frame 12, a guide rod 18 and a weight guide 14. The weight guides 14 comprise a lock device 36 that corresponds to apertures 20 in guide rod 18. The lock device 36 is moveable between a locked position and an unlocked position, wherein in the locked position, the lock device 36 engages the apertures 20 of the guide rod 18 and in the unlocked position, the lock device is disengaged from the apertures 20 of the guide rod 18. In particular embodiments, the lock device 36 is moved between the locked and unlocked position by manual rotation of the weight bar 16, thereby rotating the lock device 36. It will be understood by those of ordinary skill in the art that the lock device 36 is not limited to engaging the apertures 20, but may lock in other ways such as, but not limited to engaging the frame 12, engaging a lock bar and engaging the rollers of the weight guide 14 directly to impede movement of the weight guide 14 and any other manner of locking the weight guide 14 by action of the user.

For the exemplary purposes of this disclosure, alternative lock devices are shown in FIG. 3. Lock device 38 functions the same as lock device 36, however, lock device 36 engages the apertures 20 above the weight guide 14 while the lock device 38 engages the apertures 20 below the weight guide 14. Further, alternative lock device 40 engages lock bar 28, the lock bar 28 being coupled to the frame 12. In particular embodiments of the present invention, the lock devices 38 and 40 are manually moved from the locked position into the unlocked position by rotating the weight bar 16, thereby allowing movement of the weight guide 14.

An alternative embodiment of the weight guide 14 is shown in dashed lines as weight guide 80, in accordance with the present invention. The weight guide 80 supports the weight bar 16 between the guide rods 18 and the frame 12. The weight guide 80 comprises a lock device 82 that corresponds to apertures 20 in guide rod 18. The lock device 82 is moveable between a locked position and an unlocked position, wherein in the locked position, the lock device 82 engages the apertures 20 of the guide rod 18 and in the unlocked position, the lock device 82 is disengaged from the apertures 20 of the guide rod 18. Alternatively, other lock devices may be used and are also shown in FIG. 3. Lock device 84 functions the same as lock device 82, however, lock device 82 engages the apertures 20 above the weight guide 80 while the lock device 84 engages the apertures 20 below the weight guide 80. Further, alternative lock device 86 engages lock bars 28; the lock bars 28 being coupled to the frame 12. In particular embodiments of the present invention, the lock devices 82, 84 and 86 are manually moved from the locked position into the unlocked position by rotating the weight bar 16, thereby allowing movement of the weight guide 80.

With further reference to the drawings and particularly to FIGS. 1 and 3, particular embodiments of a dual lift apparatus 10 in accordance with the present invention may further comprise at least two safety locks 70. The at least two safety locks 70 are coupled to the at least two guide rods 18, each safety lock 70 having a lock pin 72, wherein the safety lock 70 is adjustable in height to prevent the weight guides 14 from traveling lower than the position of the safety lock 70 on the guide rod 18. The safety lock 70 is of particular benefit for users who are performing a squat lift, wherein if the user or users are unable to lift the weight, they can lower the weight guide 14 to rest on the safety locks 70. Once the weight guides 14 contact the safety locks 70, the weight guides 14 are unable to move lower and the user or users are able to move safely from under the weight bar 16. It will be understood that the safety lock 70, while of particular benefit during a squat lift, may be used in conjunction with all lifts that may be performed on the apparatus 10.

Figure 4:
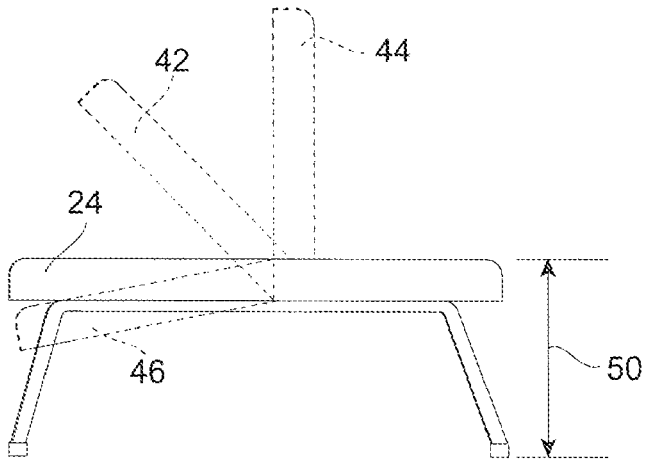
FIG. 4 is a side view of a bench of a dual lift apparatus, in accordance with embodiments of the present invention.

Referring again to the drawings, FIG. 4 depicts a side view of a bench 24 of a dual lift apparatus, according to particular embodiments of the present invention. Each bench 24 of the apparatus may be independently adjustable to account for various sizes of users. For example, and not by way of limitation, the height 50 of the bench may be varied to enable two users of different arm length and/or chest size to use the apparatus simultaneously and have a full range of motion. Various types of benches 24 may be used with the apparatus 10 as shown in FIG. 4, such as, but not limited to a horizontal bench 24, an inclined bench 42, a bench with a vertical back 44 and a declined bench 46. The various types of benches allow users to perform different exercises such as, but not limited to, the horizontal bench 24 may be used for a bench press, the inclined bench 42 for an inclined bench press, the vertical back bench 44 for a shoulder press and/or a behind the neck press, the declined bench 46 for a declined bench press, and/or the bench may be removed completely for exercises such as, but not limited to a dead lift, a squat, an upright row, a front shoulder high pull, a bent over row, a calf raiser, and a shoulder shrug.

Alternatively, the bench 24 may be adjustable between positions to allow a user to perform different lifts. For example, and without limitation, a portion of the bench 24 may be in a substantially horizontal position, an inclined position 42, a substantially vertical position 44 and a declined position 46. The angle of the bench may be varied dependent upon the particular lift to be performed.

It will be understood by those of ordinary skill in the art that the benches 24 may be removably coupled to the frame 12, wherein the benches 24 are still independently adjustable and function in accordance with the present invention. It will also be understood that the benches 24 may be removably coupled together. The benches 24 in this particular configuration would remain independently adjustable.

Figure 5:
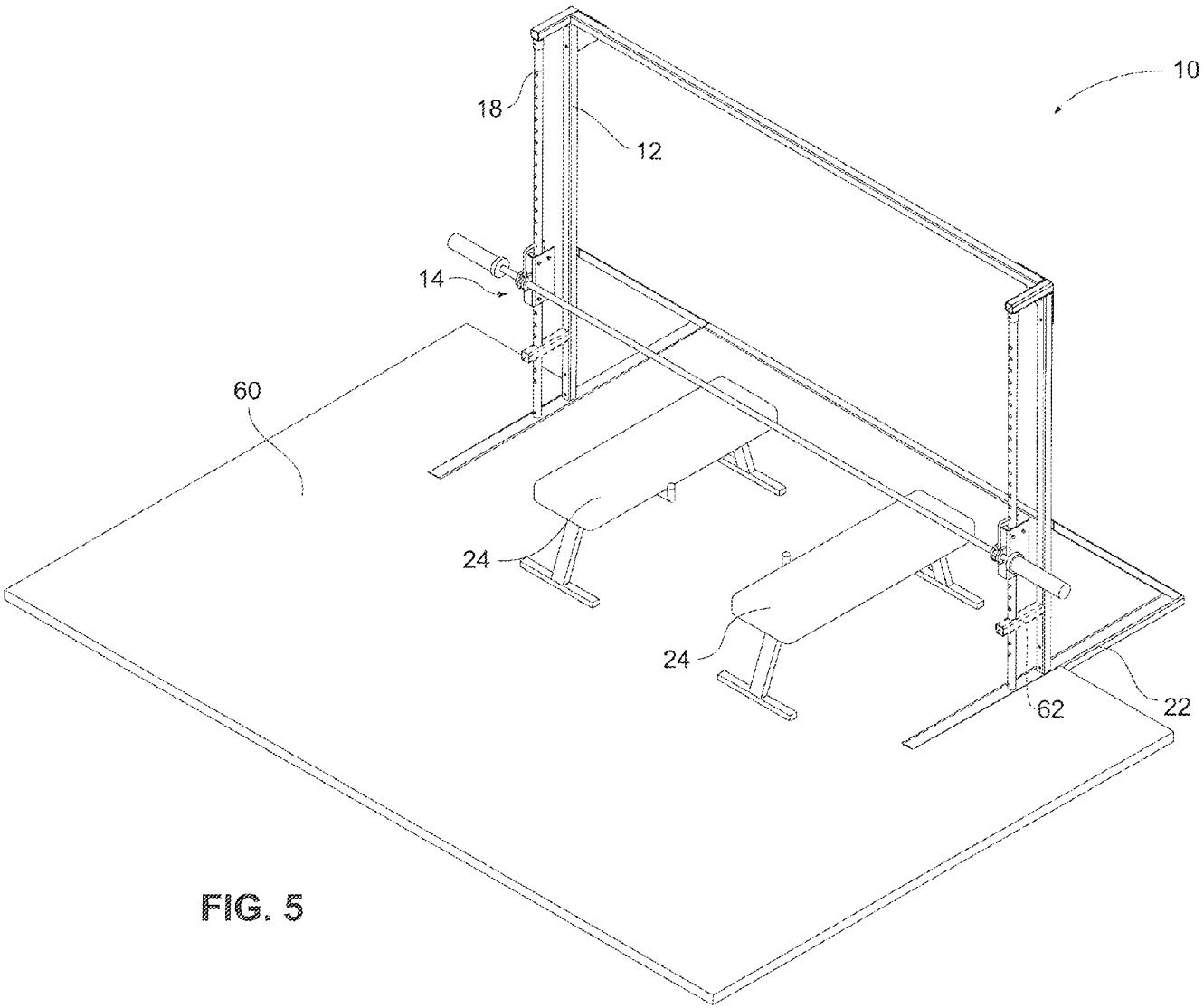
FIG. 5 is a perspective view of a dual lift apparatus with a platform, in accordance with embodiments of the present invention.

With additional reference to the drawings, FIG. 5 depicts a perspective view of a dual lift apparatus 10 of a particular embodiment of the present invention. The apparatus comprises a frame 12, a weight guide 14, a weight bar 16, a guide rod 18 and platform 60. The platform 60 may be removably coupled to a base portion 22 of the frame 12, the platform 60 supporting at least two users of the apparatus 10. The platform 60 may be removable to account for, among other reasons, limited space, and may further be formed of varying sizes and shapes to accommodate placement of the machine in various locations. Platforms as of the type of platform 60 are typically used by lifters within a competition. The use of platform 60 may also be used in lifting competitions, but use is not limited strictly to competitions. For example, the users may use benches 24 supported by the platform 60 to perform various lifts that require a bench for performance. Alternatively, the benches may be removed and the users may stand on the platform 60 and perform lifts, such as, but not limited to, a dead lift, a squat, an upright row, a front shoulder high pull, a bent over row, a calf raiser, and a shoulder shrug. The platform 60 is removable dependent on space, and may further be formed of varying sizes and shapes to accommodate placement of the apparatus 10 in various locations.

According to particular embodiments, the frame 12 may include stop 62, which limits how low the weight guides 14 may travel on the guide rods 18. In such embodiments, in order to perform a proper dead lift, for example, another removable platform may be placed on top of platform 60 in order for the user to stand on the removable platform and be at the proper level with respect to the weight bar 16 to perform a proper dead lift.

Figure 6:
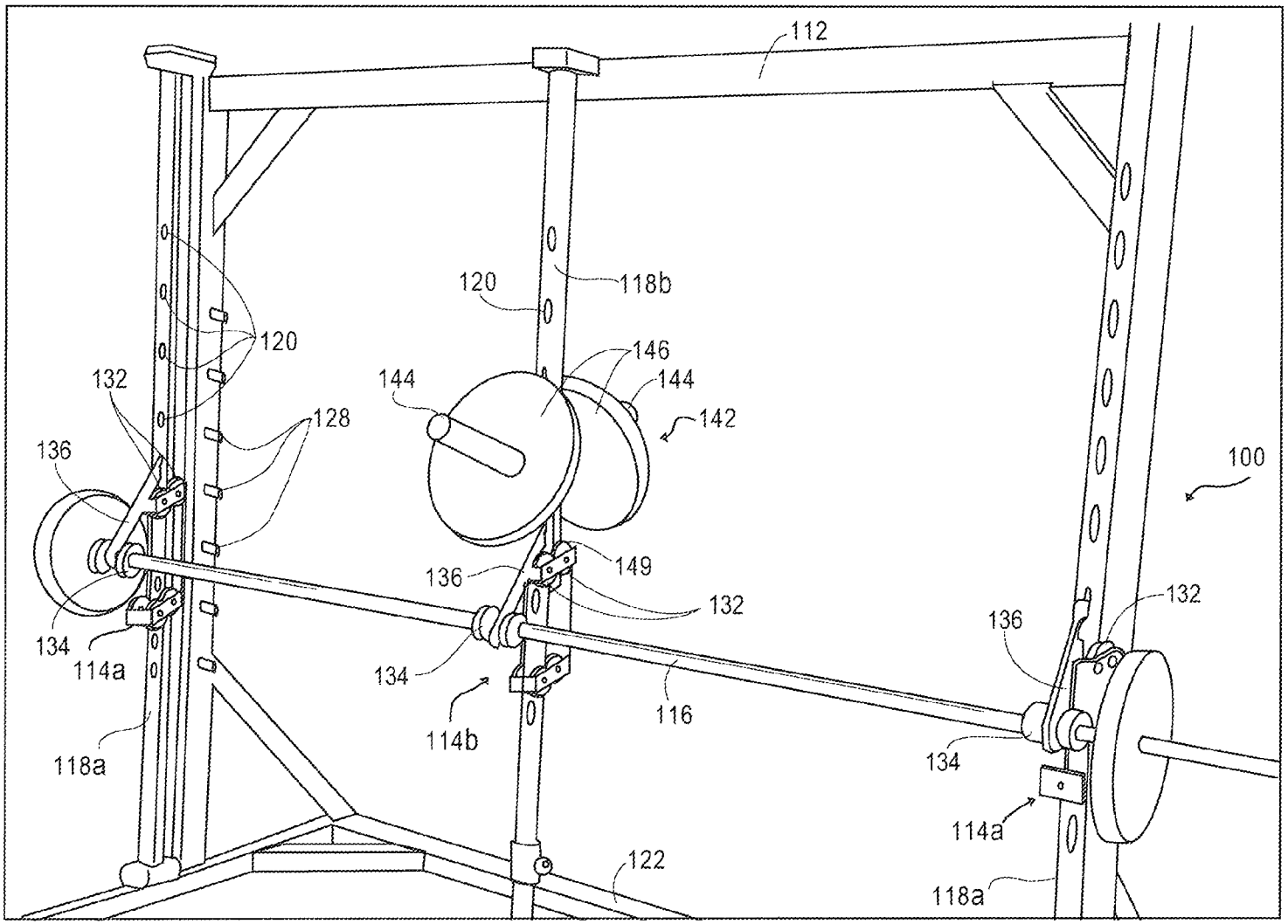
FIG. 6 is a perspective view of a dual lift apparatus with three guide rods, in accordance with embodiments of the present invention.

In another embodiment of a dual lift apparatus 100, shown in FIG. 6, the frame 112 includes two side guide rods 118*a*, a middle guide rod 118*b*, a base 122 to support the frame 112, two side weight guides 114*a*, a middle weight guide 114*b* and a weight bar 116. The guide rods 118*a* and 118*b* are coupled substantially vertical within the frame 112. There is one guide rod 118*a* on each side of the frame 112 and a third guide rod 118*b* in the middle of the frame 112. The middle guide rod 118*b* is positioned at about the center point between the two side guide rods 118*a*. The apparatus 100 may be used with or without weight benches such as the weight benches depicted in FIGS. 1 and 3-5.

Figure 7:
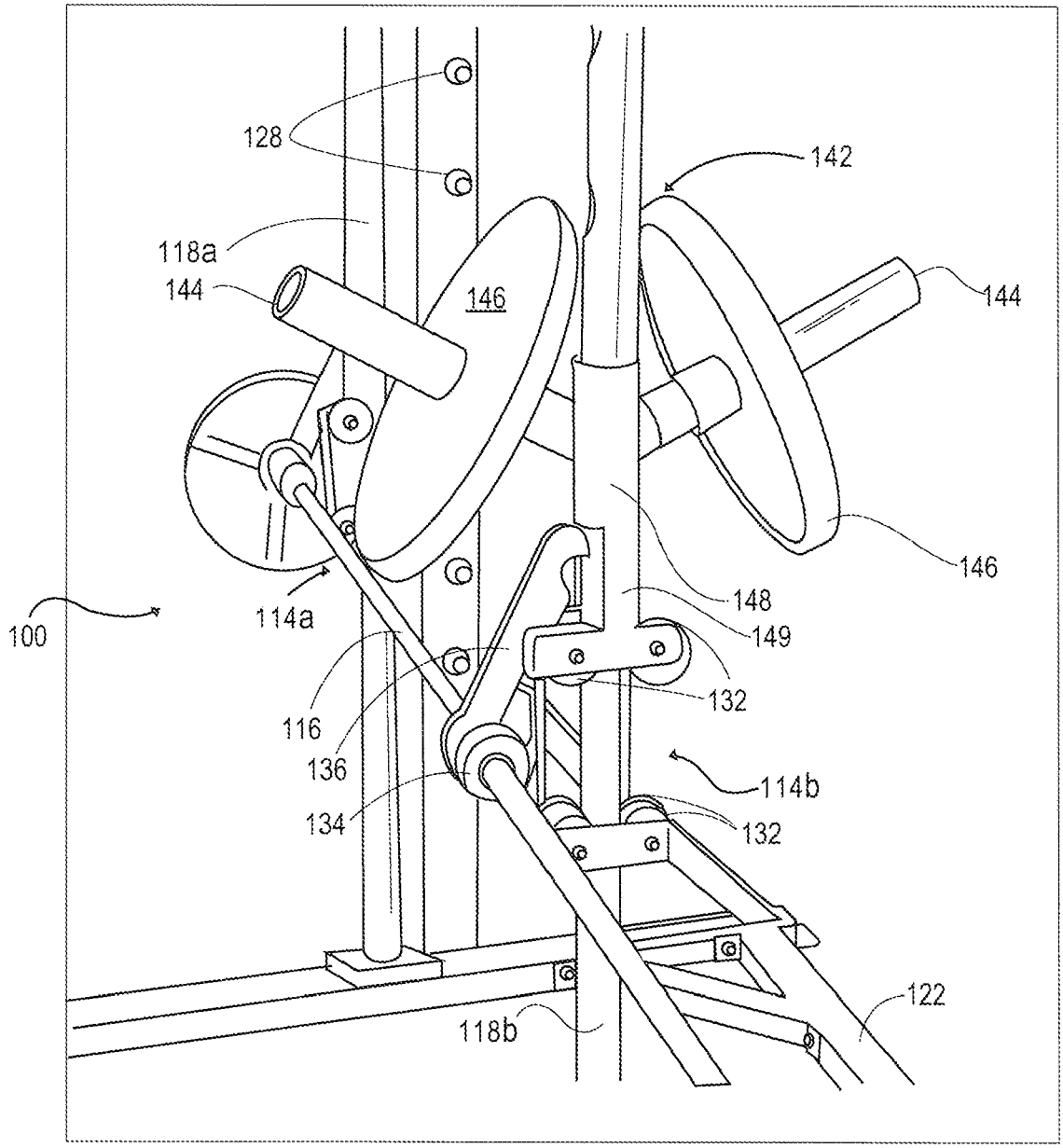
FIG. 7 is a detailed view of a weight holder coupled to a middle guide rod, in accordance with embodiments of the present invention.

The weight guides 114*a* and 114*b* are each operatively coupled to one guide rod 118*a* and 118*b*, respectively, and configured to support the weight bar 116. The weight guides 114*a* and 114*b* are similar to the weight guides 14 depicted in FIGS. 1 and 2. The middle weight guide 114*b* is shown in more detail in FIG. 7. It should be noted that the side weight guides 114*a* are substantially similar to the middle weight guide 114*b*. Each of the weight guides 114*a* and 114*b* comprise at least two rollers 132 for engaging the guide rods 118*a* and 118*b* to provide movement of the weight guides 114*a* and 114*b* and weight bar 116 along the guide rods 118*a* and 118*b*. The weight guides 114*a* and 114*b* may further comprise a weight bar receiver 134 and a lock device 136. The weight bar receiver 134 is configured to couple to the weight bar 116, while allowing the weight bar 116 to rotate about its axis. As shown in FIGS. 6 and 7, the lock device 136 may be configured to engage apertures 120 of the guide rods 118*a* and 118*b* to lock the weight guides 114*a* and 114*b* in place. It should be noted that the apertures 120 are in the guide rods 118*a* and 118*b*. Thus, the lock device 136 locks into the guide rod 118*a* or 118*b* itself. The lock device 136 may further be configured to lock onto lock bars 128 of the frame 112. Alternative configurations for lock device 136 are discussed in greater detail above with respect to FIG. 3.

In a particular embodiment, the dual lift apparatus 100 includes a weight holder 142 coupled to the middle guide rod 118*b* for more even weight distribution between the two lifters. In the embodiment shown in FIGS. 6 and 7, the weight holder 142 includes bars 144 extending substantially perpendicular to the guide rod 118*b* and to the weight bar 116. The bars 144 are coupled to the weight guide 114*b* so that the weights 146 move up and down the guide rod 118*b* with the weight guide 114*b* and the weight bar 116. The bars 144 are attached to a cylinder 148 that surrounds the guide rod 118*b*. The cylinder 148 is attached to the weight guide 114*b* through attachment 149. It should be noted that the pieces of the weight holder 142 may be attached together using any effective attachment means, such as, but not limited to, welding, riveting, bolting, etc.

The weight holder 142 depicted in FIGS. 6 and 7 is for exemplary purposes only and is not intended to be limiting. Weights may be attached to the middle portion of the weight bar 116 using any effective attachment mechanisms. For example, the weight bars 144 may extend perpendicular to the guide rod 118*b* and parallel to the weight bar 116. The weight bars 144 may be disposed below the weight guide 114*b* instead of above the weight guide 114*b*.

Figure 8:
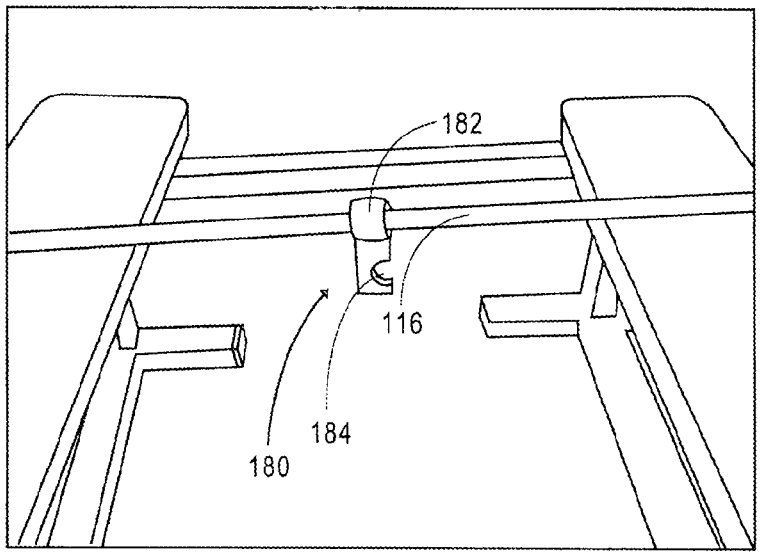
FIG. 8 is a detailed view of a weight holder coupled to a weight bar, in accordance with embodiments of the present invention.

In still another alternative embodiment, shown in FIG. 8, weights are attached to the middle portion of the weight bar 116 by a hanging weight attachment 180. The hanging weight attachment 180 may be used alone (as shown in FIG. 8) or in conjunction with the middle guide rod 118*b*. Additionally, two hanging weight attachments 180 may be used with a middle guide rod 118*b* such that a hanging weight attachment 180 is disposed on either side of the middle guide rod 118*b*. The hanging weight attachment 180 includes a cylindrical portion 182 that surrounds the weight bar 116. The hanging weight attachment 180 also includes a notch 184. Weight may be added to the hanging weight attachment 180 by hooking a bar in the notch 184 such that the bar extends downward and includes a stop plate on the end of the bar opposite the hook. The desired amount of weight may be added to the bar by placing weight plates on the bar such that the weight plates are supported by the stop plate on the end of the bar. In an alternative embodiment, weight may be added to the hanging weight attachment 180 by hooking a chain to the notch 184 and coupling weight plates to the chain. In another alternative embodiment, the notch 184 is replaced with a through hole to which a weight bar or chain may be attached. In still another alternative embodiment, the weight attachment 180 is an integral part of the weight bar 116.

Figure 9:
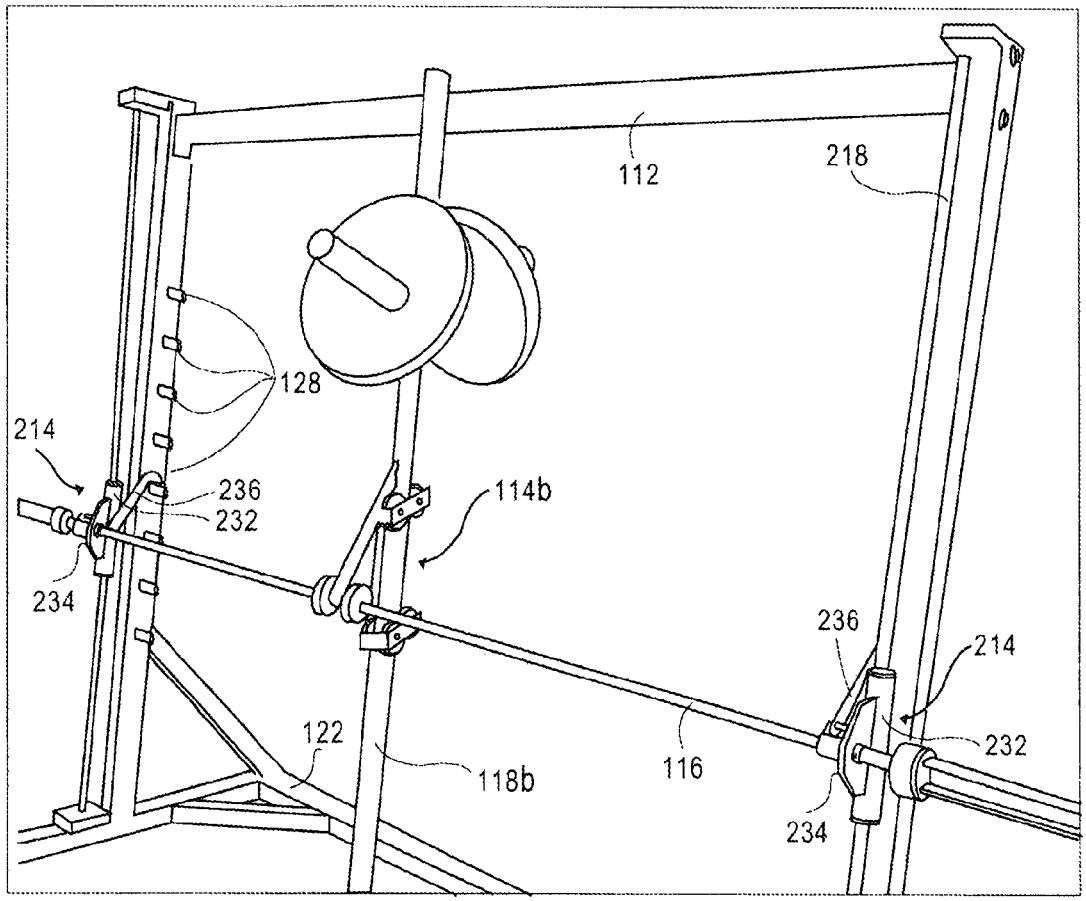
FIG. 9 is a perspective view of a dual lift apparatus with three guide rods and linear bearing weight guides, in accordance with embodiments of the present invention.

The weight guides 114*a* and 114*b* depicted in FIGS. 6 and 7 include rollers, as discussed above. Alternatively, the weight guides may include linear bearings. In the embodiment shown in FIG. 9, the two side weight guides 114*a* are replaced with linear bearings 214. The linear bearings 214 include cylindrical portions 232 that are operatively coupled to the guide rods 218 to provide movement of the weight guides 214 and the weight bar 116 along the guide rods 218. The linear bearing weight guides 214 further include a weight bar receiver 234 and a lock device 236. The weight bar receiver 234 is configured to couple to the weight bar 116, while allowing the weight bar 116 to rotate about its axis. The lock device 236 is configured to lock onto lock bars 128 of the frame 112 to lock the weight guides 214 in place. The lock device 236 is significantly different from the lock device 136 shown in FIGS. 6 and 7 in that the lock device 236 engages the lock bars 128 on another vertical rod while the lock device 136 engages the guide rod 118*a* or 118*b* itself. The middle guide rod 118*b* includes a roller weight guide 114*b*, but it should be understood that the middle guide rod 118*b* may also be configured to include a linear bearing. The linear bearings may be coupled to counter balances (not shown).

Figure 10:
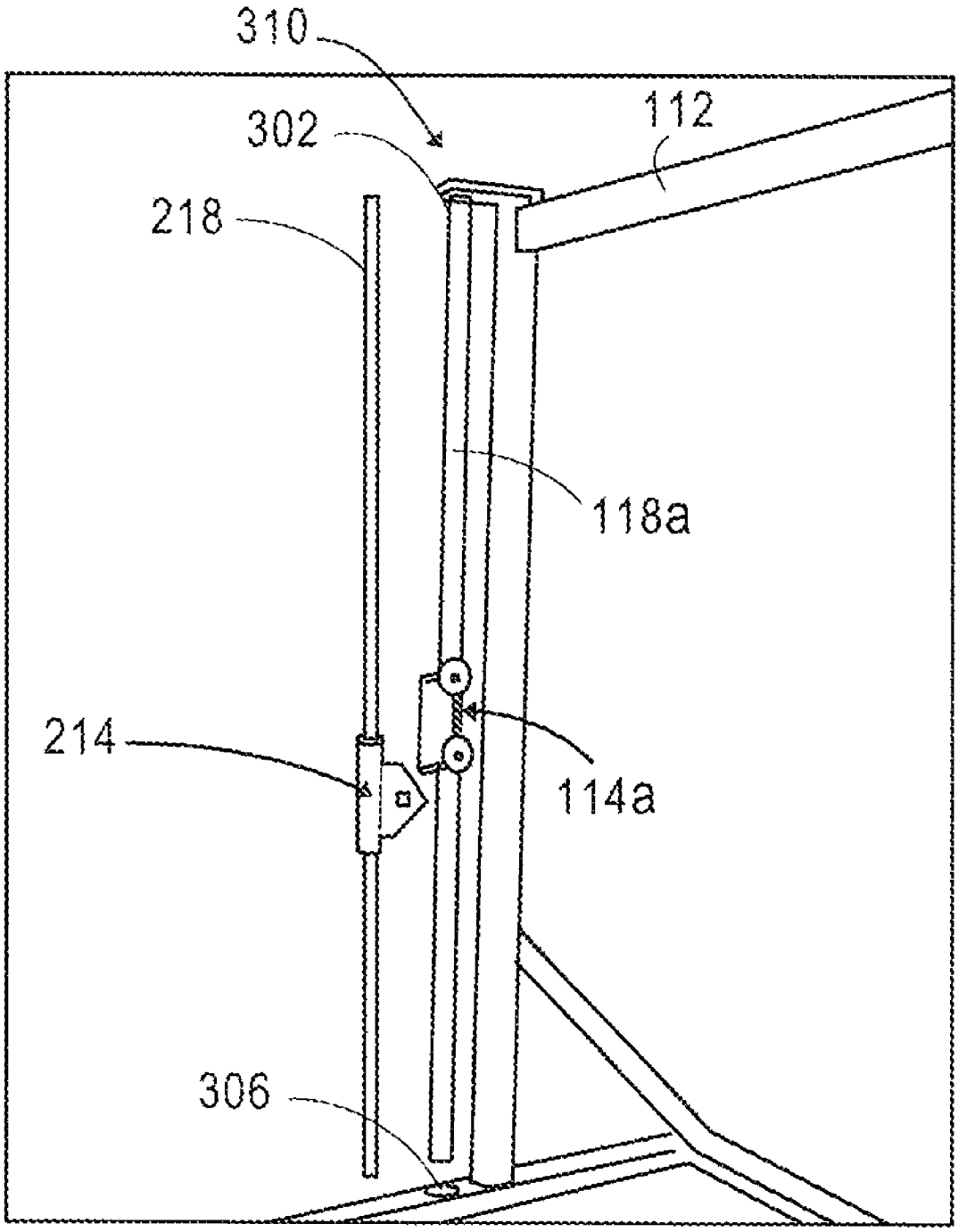
FIG. 10 is a perspective view of an adapter for switching between a roller weight guide and a linear bearing weight guide, in accordance with embodiments of the present invention.
Figure 11:
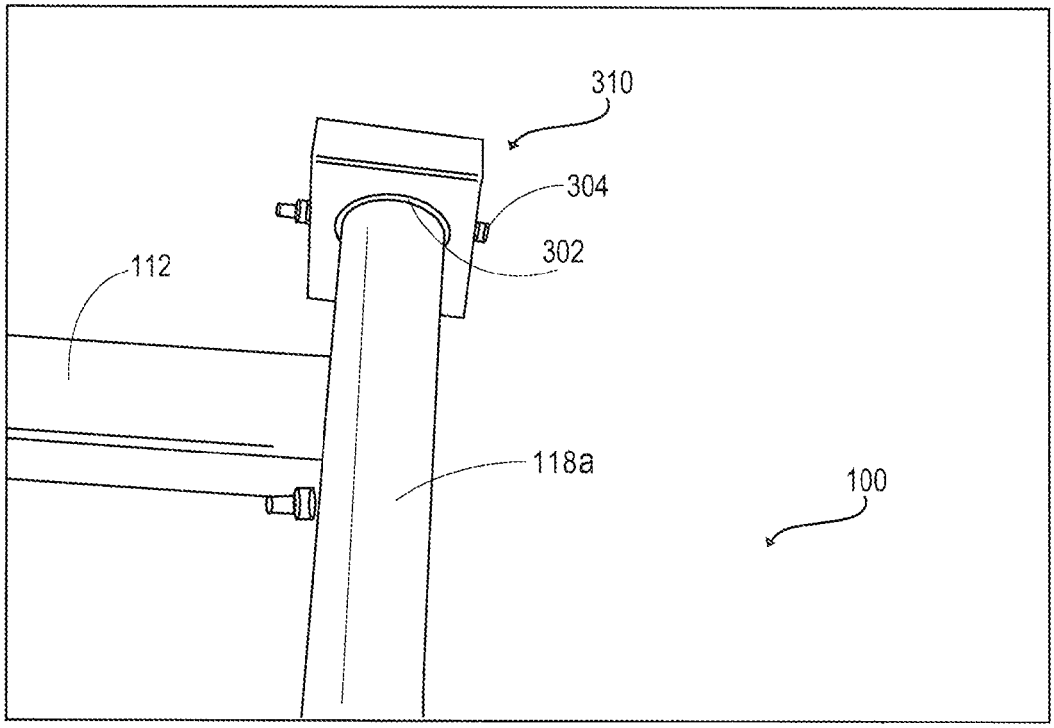
FIG. 11 is an enlarged view of the adapter with a guide rod coupled thereto, in accordance with embodiments of the present invention.

In still another embodiment, the frame 112 may include an adapter 310 for switching between a guide rod 118*a* with a roller weight guide 114*a* and a guide rod 218 with a linear bearing weight guide 214. FIG. 10 shows the frame 112 with the guide rod 118*a* and roller weight guide 114*a* coupled thereto. The adapter 310 allows for the replacement of the guide rod 118*a* with the guide rod 218 shown in FIG. 10. The top of the guide rod 118*a* is disposed in an upper opening 302 and the bottom of the guide rod 118*a* is disposed in a lower opening 306. The inside diameter of the openings 302 and 306 is substantially equal to the outside diameter of the guide rod 118*a*. As shown in more detail in FIG. 11, the top of the guide rod 118*a* is retained in the upper opening 302 using a bolt 304 that passes through the opening 302 and through a through hole in the top of the guide rod 118*a*. In order to switch from the guide rod 118*a* to the guide rod 218, the bolt 304 is removed. After removing the bolt 304, the guide rod 118*a* is able to slide down and the top of the guide rod 118*a* is removed from the upper opening 302. Then, the guide rod 118*a* is moved upwards so that the bottom of the guide rod 118*a* may be removed from the lower opening 306.

Figure 12:
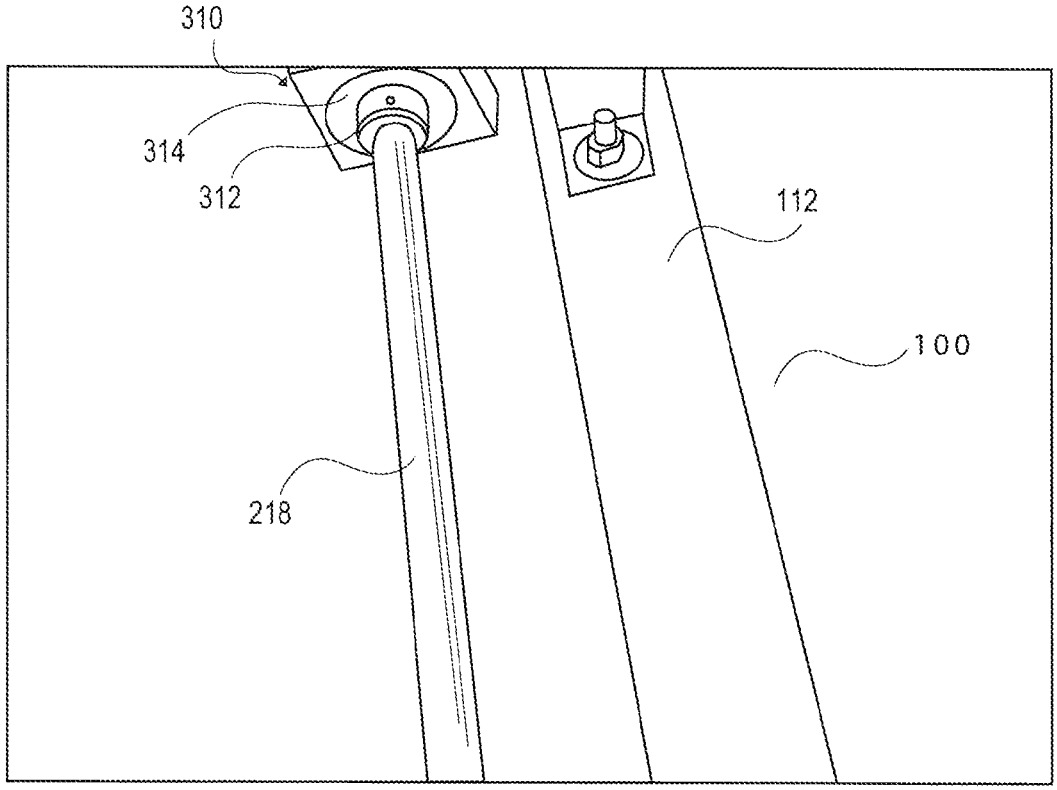
FIG. 12 is an enlarged view of the adapter with another guide rod coupled thereto, in accordance with embodiments of the present invention.

After removal of the guide rod 118*a*, the guide rod 218 may be positioned within the frame 112 using an adapter 310. The guide rod 218 has a smaller diameter than the guide rod 118*a*, so the lower opening 306 includes a smaller opening (not shown) in the bottom of the lower opening 306. The inside diameter of the smaller opening is substantially equal to the outside diameter of the guide rod 218. The bottom of the guide rod 218 is positioned within the smaller opening. Then, as shown in FIG. 12, the top of the guide rod 218 is positioned within a shaft collar 312 with an inside diameter substantially equal to the outside diameter of the guide rod 218. The shaft collar 312 is attached to a washer 314 with an outside diameter larger than the inside diameter of the opening 302. The washer 314 is attached to another shaft collar, not shown, with a larger outside diameter than the shaft collar 312. The larger shaft collar is removably secured within the upper opening 302.

Other particular embodiments of a dual lift apparatus in accordance with the present invention may further comprise a weight rack. The weight rack may be coupled anywhere onto the frame of the apparatus, so long as the weight rack does not interfere with the user or weight bar during a lift exercise. The weight rack may include weight storage posts (not shown) attached to the frame for storing weight plates so that plates may be conveniently and efficiently swapped out.

Figure 13:
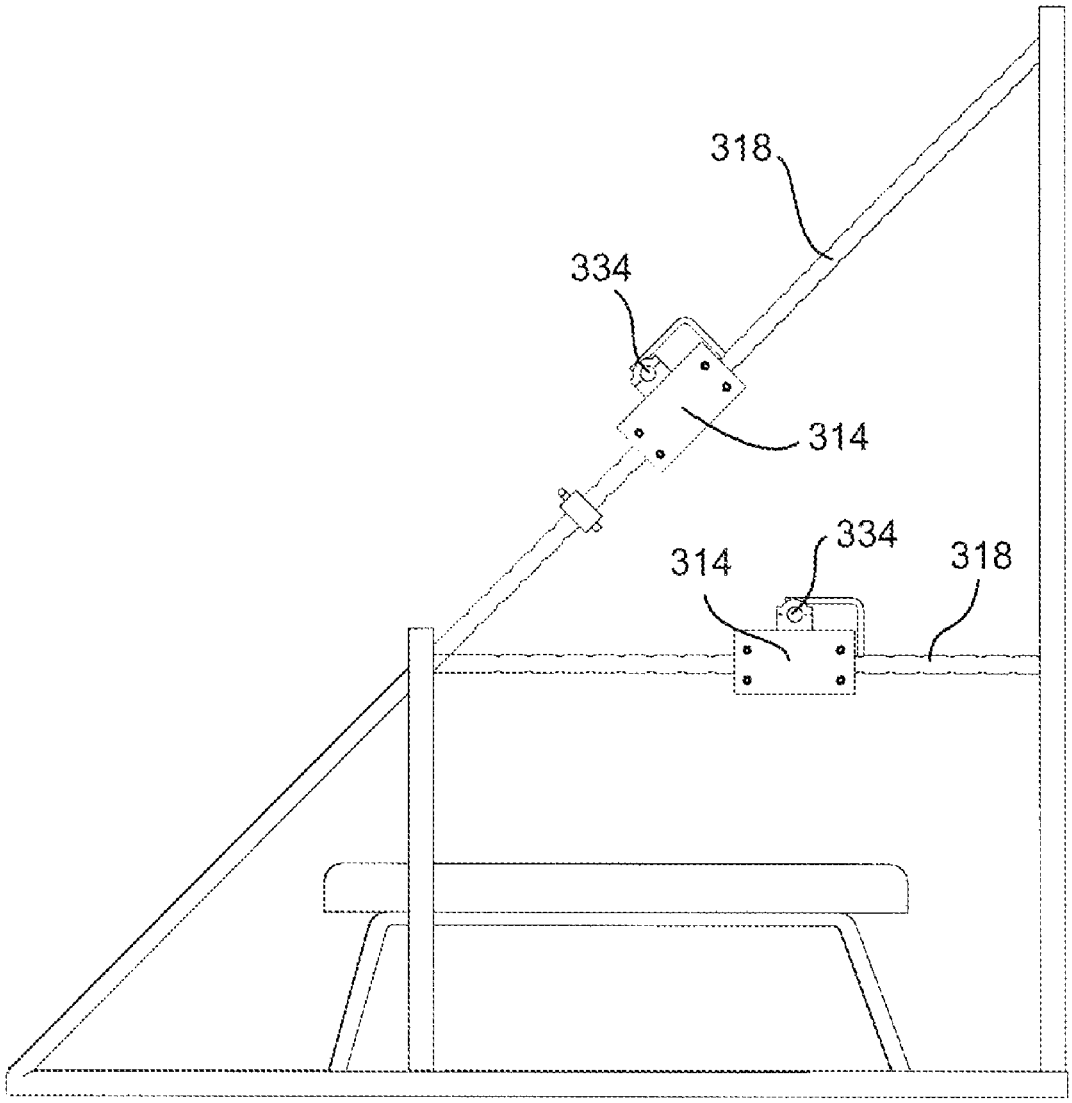
FIG. 13 is a side view of a weight lifting apparatus, in accordance with embodiments of the present invention.

The weight guides with rollers are not limited to vertical movement. For example, as shown in FIG. 13, the weight guides 314 with rollers may be used in an apparatus where the guide rod 318 is positioned horizontally, diagonally, etc. The rollers are engaged with the guide rod 318 and the weight guide 314 is coupled to the weight bar receiver 334 which holds the weight bar 316. This arrangement restricts the movement of the weights along the guide rod 318. The guide rod 318 may be vertical, horizontal, or any other angle in between vertical and horizontal.

Accordingly, the components defining any embodiment of a dual lift apparatus may be formed of any of many different types of materials or combinations thereof that can readily be formed into shaped objects provided that the components selected are consistent with the intended operation of a dual lift apparatus. For example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any embodiment of a dual lift apparatus may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A dual lift apparatus for use by two people for lifting the same weight simultaneously, the apparatus comprising:

a frame supported by a base;

three upright guide rods of about the same length, extending from said base and coupled within the frame to occupy a substantially common plane;

an elongate weight bar having opposite ends each end adapted to support a weight thereon, said elongate weight bar configured for engagement by two people simultaneously; and three weight guides, each weight guide operatively coupled to selectively slide along a respective guide rod and each weight guide configured to rotatable support a portion of said elongate weight bar, wherein said elongate weight bar spans said three weight guides and said three guide rods so that two people may position their bodies beneath said elongate weight bar, simultaneously engage said elongate weight bar, and simultaneously lift said elongate weight bar and any weights supported by said elongate weight bar by sliding said elongate weight bar relative to said three upright guide rods.

2. The apparatus of claim 1, wherein a first weight guide comprises at least two rollers and the first weight guide is one of the three weight guides.

3. The apparatus of claim 2, wherein the first weight guide is coupled to a first guide rod and the first guide rod is one of the three guide rods, and wherein the at least two rollers engage the first guide rod to provide movement of the first weight guide and the weight bar along the first guide rod.

4. The apparatus of claim 1, wherein a first weight guide comprises a linear bearing and the first weight guide is one of the three weight guides.

5. The apparatus of claim 4, wherein the first weight guide is coupled to a first guide rod and the first guide rod is one of the three guide rods, and wherein the linear bearing engages the first guide rod to provide movement of the first weight guide and the weight bar along the first guide rod.

6. The apparatus of claim 1, further comprising an adapter for switching between a roller weight guide and a linear bearing weight guide.

7. The apparatus of claim 1, further comprising a weight holder positioned at about a center point of the weight bar.

8. The apparatus of claim 1, wherein the three guide rods comprise two side guide rods and a middle guide rod.

9. The apparatus of claim 8, wherein said three weight guides comprise linear bearing weight guides coupled to the two side guide rods and a roller weight guide coupled to the middle guide rod.

10. A dual lift apparatus for use by two people for lifting the same weight simultaneously, the apparatus comprising:

a frame supported by a base;

at least three upright guide rods of about the same length extending from said base and coupled within the frame to occupy a substantially common plane;

an elongate weight bar having opposite ends, each end adapted to support a weight thereon, said elongate weight bar configured for engagement by two people simultaneously;

at least one weight guide selected from the group consisting of a roller weight guide and a linear bearing weight guide, said at least one weight guide operatively coupled to selectively slide along at least one of said at least three guide rods and said at least one weight guide configured to rotatable support a portion of said elongate weight bar, wherein said elongate weight bar spans said at least one weight guide and said at least three guide rods so that two people may position their bodies beneath said elongate weight bar, simultaneously engage said elongate weight bar, and simultaneously move said elongate weight bar and any weights supported by said elongate weight bar by sliding said elongate weight bar relative to said at least three upright guide rods; and at least one adapter for switching between a roller weight guide and a linear bearing weight guide.

11. The apparatus of claim 10, wherein the at least three guide rods comprise two side guide rods and a middle guide rod.

12. The apparatus of claim 11, wherein the middle guide rod is positioned at about the center point between the two side guide rods.

13. The apparatus of claim 12, further comprising a weight holder coupled to the middle guide rod.

14. The apparatus of claim 11, further comprising two adapters, wherein each adapter is coupled to one of the side guide rods.

15. The apparatus of claim 10, further comprising a weight holder coupled to the weight bar at about the center point of the weight bar.

16. The apparatus of claim 10, wherein at least two of the at least three guide rods are removably coupled to the frame.

17. A dual lift apparatus for use by two people for lifting the same weight simultaneously weights, comprising:

at least three substantially similar guide rods of about the same length extending from a base and coupled within a frame to occupy a substantially common plane;

an elongate weight bar having opposite ends, each end adapted to support a weight thereon, said elongate weight bar configured for engagement by two people simultaneously; and at least one weight guide operatively coupled to selectively slide along at least one of the at least three guide rods and said at least one weight guide configured to rotatably support a portion of said elongate weight bar, wherein said elongate weight bar spans said at least one weight guide and said at least three guide rods so that two people may position their bodies beneath said elongate weight bar, simultaneously engage said elongate weight bar, and simultaneously lift said elongate weight bar and any weights supported by said elongate weight bar by sliding said elongate weight bar relative to said at least three guide rods, wherein the at least one weight guide comprises at least two rollers, and wherein the at least two rollers engage at least one of the at least three guide rods.

18. The apparatus of claim 17, wherein the three substantially similar guide rods are positioned horizontally, vertically, or diagonally.

19. The apparatus of claim 17, wherein an outer surface of each of the at least two rollers corresponds to a shape of the at least one guide rod to provide direct contact between the at least two rollers and the at least one guide rod.

* * * * *

UNITED STATES PATENT AND TRADEMARK OFFICE

CERTIFICATE OF CORRECTION

PATENT NO. : 7,520,843 B1
APPLICATION NO. : 11/776515
DATED : April 21, 2009
INVENTOR(S) : Dan Goddard It is certified that error appears in the above-identified patent and that said Letters Patent is hereby corrected as shown below:

Col. 10, Line 40 should read; --...configured to rotatably support…--

Col. 11, Line 25 should read; --...configured to rotatably support…--

Signed and Sealed this

Thirtieth Day of June, 2009

John Doll

JOHN DOLL
*Acting Director of the United States Patent and Trademark Office*